US006527306B1

(12) United States Patent
Roncato

(10) Patent No.: US 6,527,306 B1
(45) Date of Patent: Mar. 4, 2003

(54) CLOSING ASSEMBLY FOR SUITCASES, BAGS AND SIMILAR

(75) Inventor: Enrico Roncato, Campodarsego (IT)

(73) Assignee: Valigeria Roncato S.p.A., Padua (IT)

( * ) Notice: Subject to any disclaimer, the term of this patent is extended or adjusted under 35 U.S.C. 154(b) by 100 days.

(21) Appl. No.: 09/658,427

(22) Filed: Sep. 8, 2000

(30) Foreign Application Priority Data

Sep. 13, 1999 (EP) ..... 99830574

(51) Int. Cl.[7] ..... E05C 1/06

(52) U.S. Cl. ..... 292/33; 292/56; 292/68; 292/111; 292/DIG. 42; 70/67; 70/69

(58) Field of Search ..... 70/312, 67, 69–75; 292/56, 63, 68, 109, 110, 111, 113, 114, DIG. 42

(56) References Cited

U.S. PATENT DOCUMENTS

| | | | | | |
|---|---|---|---|---|---|
| 1,370,941 | A | * | 3/1921 | Binkley | 70/129 |
| 2,294,120 | A | | 8/1942 | Levine | |
| 2,729,088 | A | * | 1/1956 | Huot et al. | 292/159 |
| 3,135,105 | A | * | 6/1964 | Brody | 190/115 |
| 3,400,562 | A | * | 9/1968 | Bloss | 292/118 |
| 3,498,657 | A | * | 3/1970 | Fontana | 292/34 |
| 4,365,490 | A | * | 12/1982 | Manzoni | 292/221 |
| 4,366,686 | A | * | 1/1983 | Remington et al. | 70/312 |
| 4,547,006 | A | * | 10/1985 | Castanie | 292/159 |
| 5,111,918 | A | | 5/1992 | Bako et al. | |
| 5,557,954 | A | * | 9/1996 | Ling | 70/312 |
| 6,202,455 | B1 | * | 3/2001 | Su | 70/68 |

FOREIGN PATENT DOCUMENTS

| | | |
|---|---|---|
| DE | 805053 | 5/1951 |
| DE | 2010085 | 9/1971 |
| DE | 9308167 | 9/1993 |

* cited by examiner

*Primary Examiner*—J. J. Swan
*Assistant Examiner*—Matthew E. Rodgers
(74) *Attorney, Agent, or Firm*—Karlow & Springut LLP

(57) ABSTRACT

A closing assembly for bags, suitcases and similar, comprises at least one pair of catch means which are associated with a first half-shell of a bag, suitcase or similar and are capable of providing a releasable engagement with a corresponding pair of counter-catch means associated with a second half-shell of the bag, suitcase or similar for closing it. There are provided jointly activatable inhibition means for inhibiting the opening of the bag, suitcase or similar, operationally connected to the at least one pair of catch means and jointly activatable to block the release of the engagement with the pair of counter-catch means.

17 Claims, 7 Drawing Sheets

CLOSING ASSEMBLY FOR SUITCASES, BAGS AND SIMILAR

FIELD OF THE INVENTION

The present invention relates to a closing assembly for suitcases, bags and similar. In particular, the invention relates to a front closing assembly.

BACKGROUND OF THE INVENTION

There are known suitcases, particularly of the rigid type, which are provided frontally with a closing element comprising a catch formed at one end of a lever swinging around a pivot, which in turn is located at one end of an arm pivoted approximately at the edge of the front surface of one part of the suitcase, typically the base. A counter-catch is formed in a corresponding position in the proximity of the edge of the front surface of the other part, typically the lid. The lever is also normally associated with a combination or key-operated device.

With this type of closing element, the catch is brought into a position of engagement with the counter-catch by acting on the swinging element after the lid has been closed on to the base of the suitcase, and a tractive force is exerted on the lid by rotating the lever and the arm until the lever is brought into a closing position in which it is essentially aligned with the outer wall of the base of the case. By acting on the combination or key-operated device, it is then possible to lock the lever in the closing position. For opening, after unlocking the combination or key-operated device, it is necessary to act on the lever again, raising it to disengage the catch from the counter-catch.

There are also known suitcases provided frontally with a pair of closing elements of the type described above, identical to each other but structurally and functionally independent, fitted separately to the front surface of the suitcase in positions spaced apart from each other, each being provided with a corresponding combination or key-operated device for safety locking in the closed position.

This solution permits a better distribution of the forces both during the closing of the suitcase and when the suitcase is closed. On the other hand, since each of the closing elements is provided with its own independent combination or key-operated device, the manufacture of the safety lock for the closed position is time-consuming. If, however, these safety devices are combination devices, which, being independent, allow the setting of release combinations which are different from each other, there is a risk that the user will forget one of the two release combinations, and will no longer be able to open the suitcase.

SUMMARY OF THE INVENTION

In view of the prior art which has been described, one object of the present invention was to provide a closing assembly for bags, suitcases and similar, particularly for use as a front closing assembly, which does not have the aforesaid disadvantages.

According to the present invention, this object is achieved by means of a closing assembly for bags, suitcases and similar, comprising at least one pair of catch means associated with a first half-shell of a bag, suitcase or similar and capable of providing a releasable engagement with a corresponding pair of counter-catch means associated with a second half-shell of the bag, suitcase or similar for closing it, characterized by comprising jointly activatable inhibition means for inhibiting the opening of the bag, suitcase or similar, operationally connected to the said at least one pair of catch means and jointly activatable to simultaneously inhibit the release of the engagement with the said pair of counter-catch means.

BRIEF DESCRIPTION OF THE DRAWINGS

The features and advantages of the present invention will be made clear by the following detailed description of a practical embodiment thereof, illustrated purely by way of a non-limiting example in the attached drawings, in which.

DETAILED DESCRIPTION OF A PREFERRED EMBODIMENT

With reference to the figures, a closing assembly according to the present invention comprises a one-piece body 1 designed to be mounted on one of two half-shells forming a suitcase, a bag or similar, for example the half-shell forming a base of the suitcase. In particular, the one-piece body 1 is designed to be mounted on a front surface of the base of the suitcase, essentially in the proximity of one edge of the front surface, in a median position.

Figure 2:
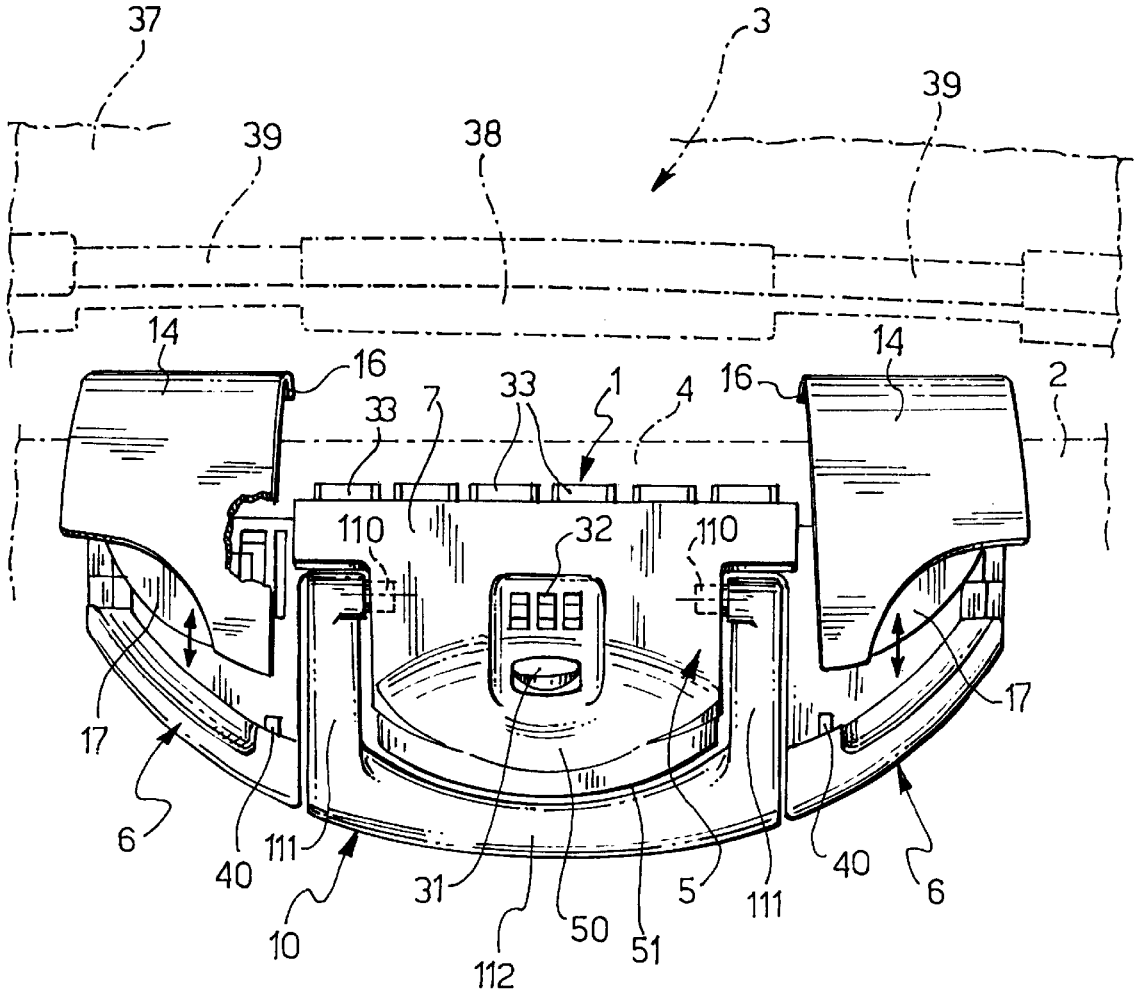
FIG. 2 is a plan view from above of the closing assembly shown in FIG. 1, complete with a handle for lifting and carrying a suitcase shown schematically in broken lines.

The one-piece body 1 comprises a central part 5 and two lateral extensions 6 connected to the central part 5 by a cross-piece 7. Advantageously, approximately U-shaped slots 9, which are open and flared below, are formed in two opposite lateral walls 8 of the central part 5, and form sockets to receive with a snap-fit and with the possibility of rotation corresponding pivots 110 of a handle 10 for lifting and carrying the suitcase. For simplicity of the drawings, the handle 10 is shown only in FIGS. 2, 8 and 9. In FIG. 2 it will also be noted that the distance between the lateral walls 8 of the central part 5 and the corresponding adjacent extensions 6 is such that corresponding bars 111 of the handle 10 can be housed therein with sufficient play. Additionally, the central part 5 advantageously has, opposite the cross-piece 7, a surface 50 sloping downwards towards an edge 51 with a generally rounded profile mating with the rounded profile of a cross-piece 112 of the handle 10. In turn, the extensions 6 extend orthogonally to the cross-piece 7 of the one-piece body 1 further than the central part 5, and their sides opposite the cross-piece 7 have a generally rounded configuration which forms the ideal continuation of the cross-piece 112 of the handle 10. This contributes to the imparting of a harmonious, compact and aesthetically pleasing appearance to the assembly of the one-piece body 1 and the handle 10.

Figure 1:
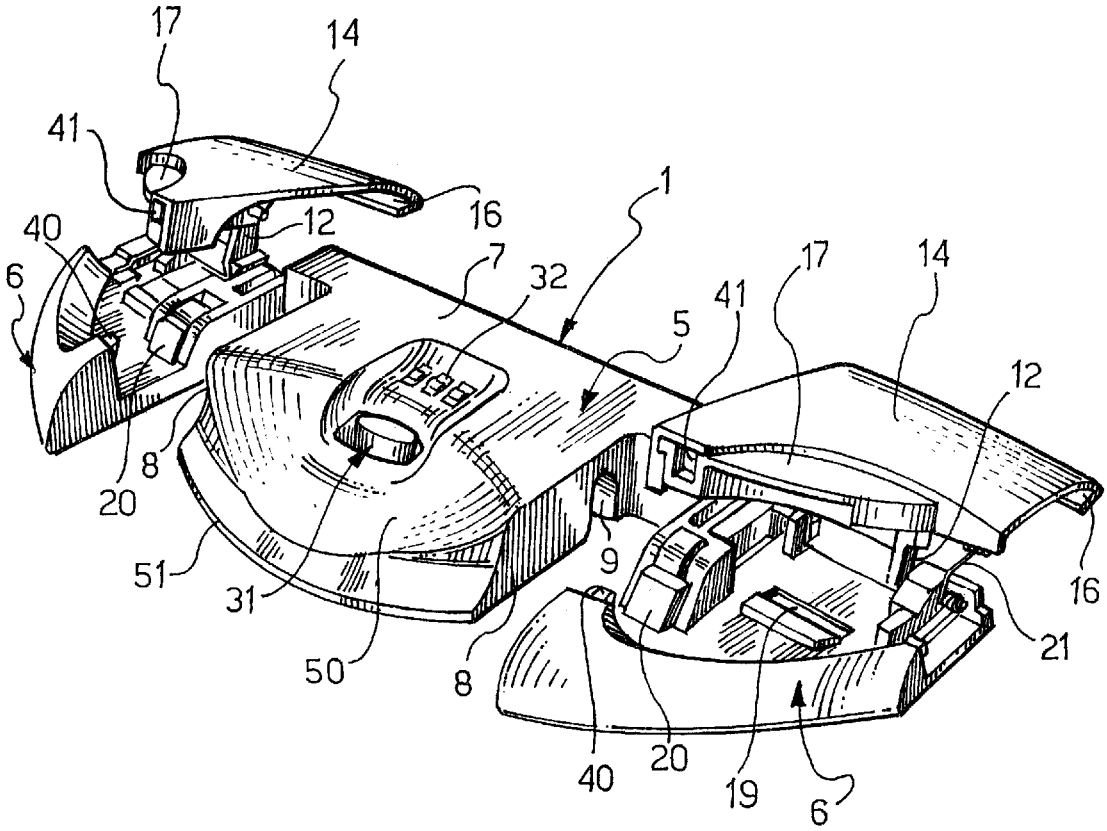
FIG. 1 is a perspective view of a closing assembly according to the present invention.
Figure 3:
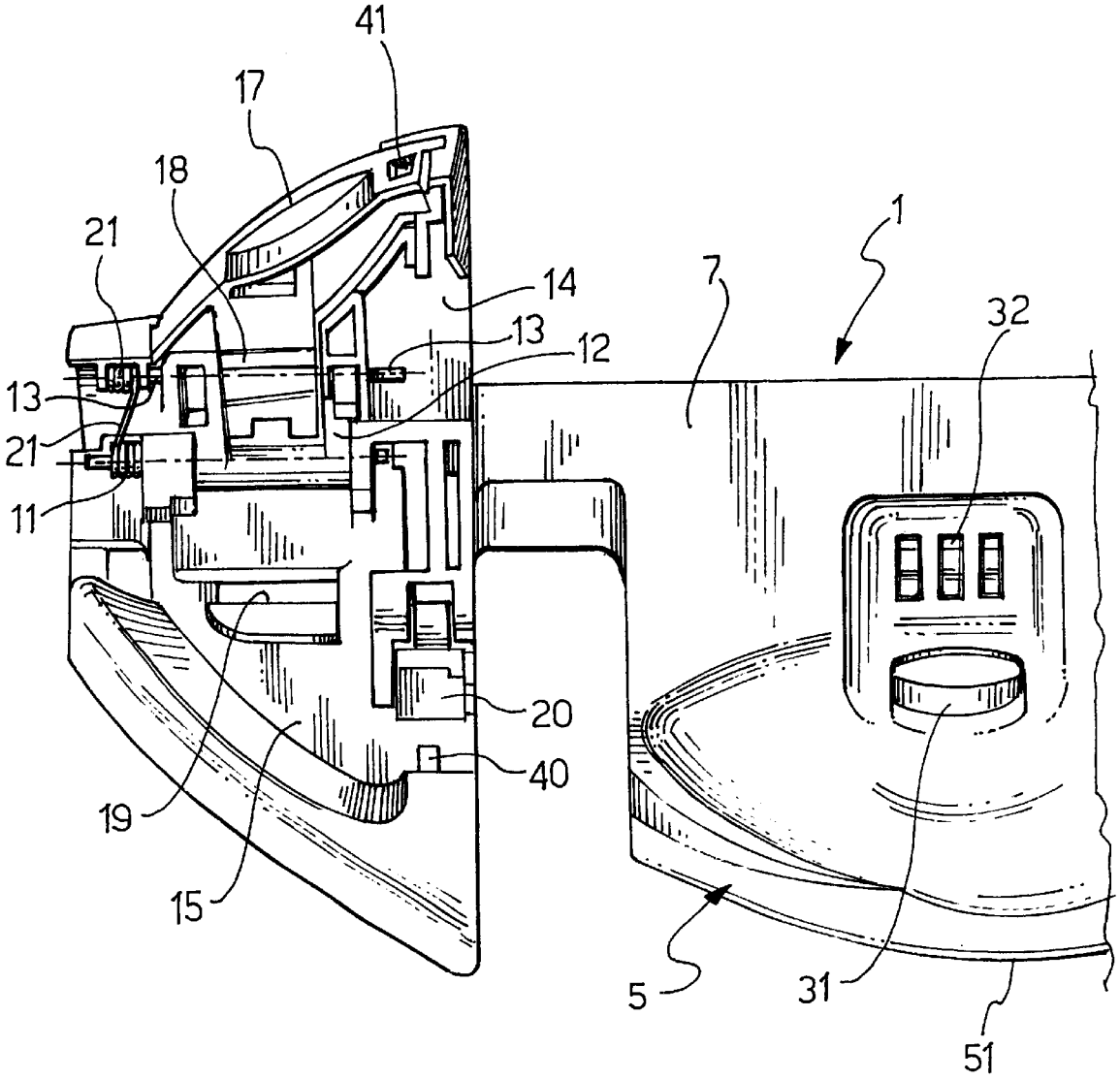
FIG. 3 is a plan view from above of a detail of the closing assembly.

Each of the two lateral extensions 6 has hinged to it by a first pivot 11 one end of a corresponding arm 12, to whose other end a corresponding lever 14 is hinged by a second pivot 13 (FIG. 3). A spiral spring 21 wound on the pivots 11 and 13, and with end portions acting on the extension 6 and on the lever 14 respectively, pushes the arm 12 and the lever 14 into the position shown in FIG. 1, a position in which the levers 14 are partially raised with respect to the corresponding lateral extensions 6, ready for a closing operation.

The lateral extensions 6 of the one-piece body 1 are shaped in such a way as to form sockets 15 to receive the corresponding levers 14, in an operating condition in which the assembly is closed.

One end of the lever 14 is shaped in such a way as to form a catch 16. The other end of the lever 14 has, slidably associated with it, a release slider 17 provided on its lower surface with a catch 18 capable of interacting, when the lever 14 is housed in the corresponding socket 15 of the lateral extension 6, with a corresponding counter-catch 19 formed in the base of the socket 15 of the lateral extension 6. A socket 41, capable of receiving a projection 40 formed in the corresponding extension 6 when the lever 14 is housed in the socket 15 of the extension 6, is also formed in the release slider 17.

The release slider 17 is pressed elastically by a spring which is not visible in the drawings, in such a way that the catch 18 is kept in a position such as to ensure the engagement with the counter-catch 19, and that the socket 41 projects towards the corresponding projection 40. However, when the release slider 17 is pushed against the elastic pressure of the spring, the catch 18 advances and can disengage the counter-catch 19, and the socket 41 moves away from the projection 40, and therefore the lever 14 can be raised from the corresponding socket 15.

A locking slider 6 is also slidably housed in the lateral extension 6, and is elastically pushed by a corresponding spring 150 visible in the views from below in FIGS. 6 and 7 into a position such that, when the lever 14 is positioned within the corresponding socket 15, the catch 18 engaging with the counter-catch 19 and the projection 40 engaging with the socket 41, the locking slider 20 is elastically opposed to the movement of the release slider 17, so that, in order to release the catch 18 from the counter-catch 19, to release the socket 41 from the projection 40 and to release the lever 14, it is necessary to overcome the resistance of the locking slider 20 to the movement of the release slider 17.

Figure 4:
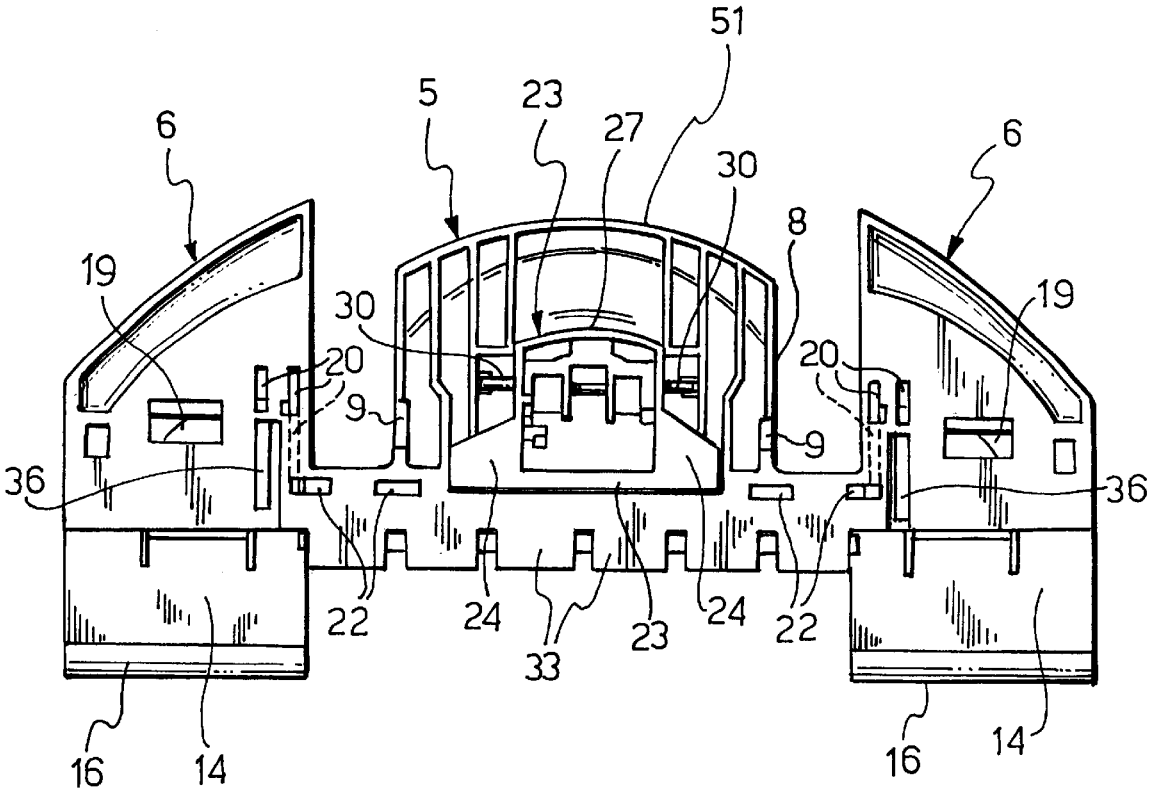
FIG. 4 is a plan view from below of the closing assembly.
Figure 6:
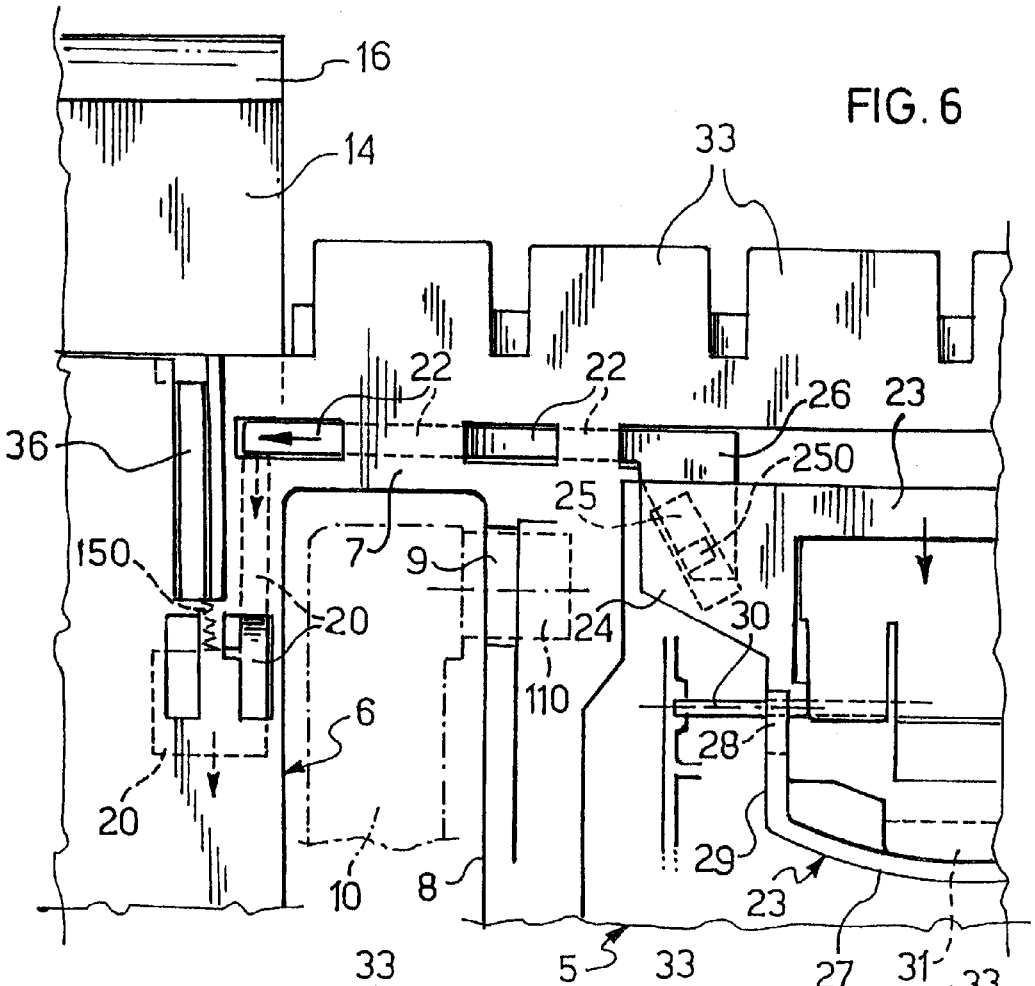
FIGS. 6 and 7 show, in a plan view from below and in two different operating conditions, a further detail of the closing assembly.
Figure 7:
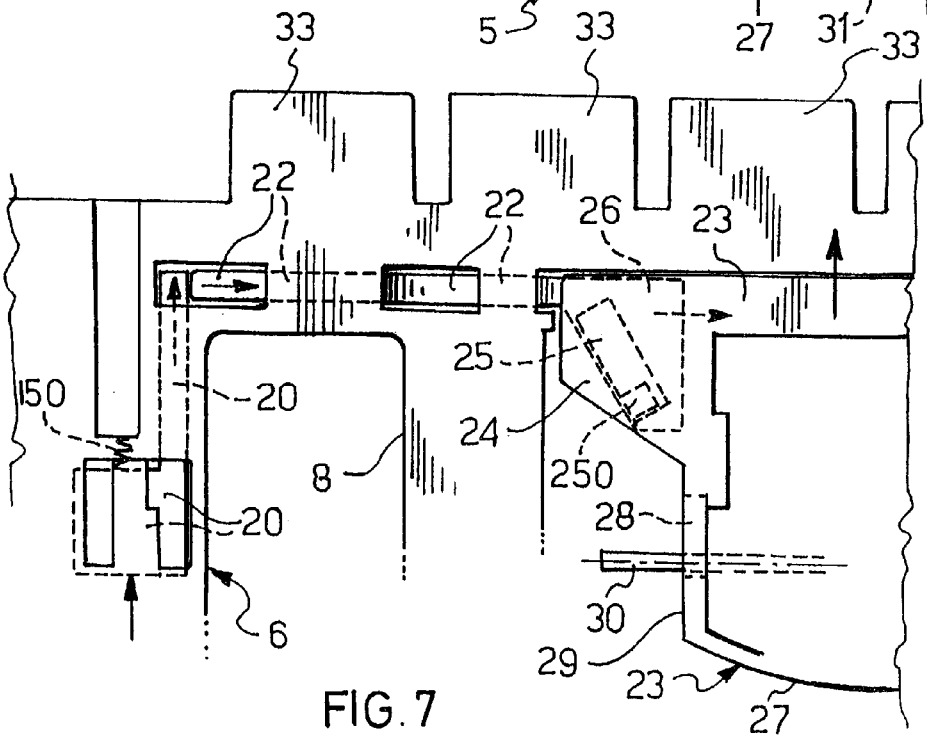

The sliding of the locking sliders 20 in the two lateral extensions 6 can be obstructed by the movement of a pair of arms 22, visible in FIG. 4 and in greater detail in FIGS. 6 and 7, which are slidably housed in corresponding sliding channels formed within the cross-piece 7, transversely with respect to the direction of sliding of the locking sliders 20. The two arms 22 act as blockers, selectively releasing (FIG. 7) or blocking (FIG. 6) one end of the sliding channels of the locking sliders 20, thus allowing or obstructing, respectively, the sliding of the locking sliders 20.

Figure 5:
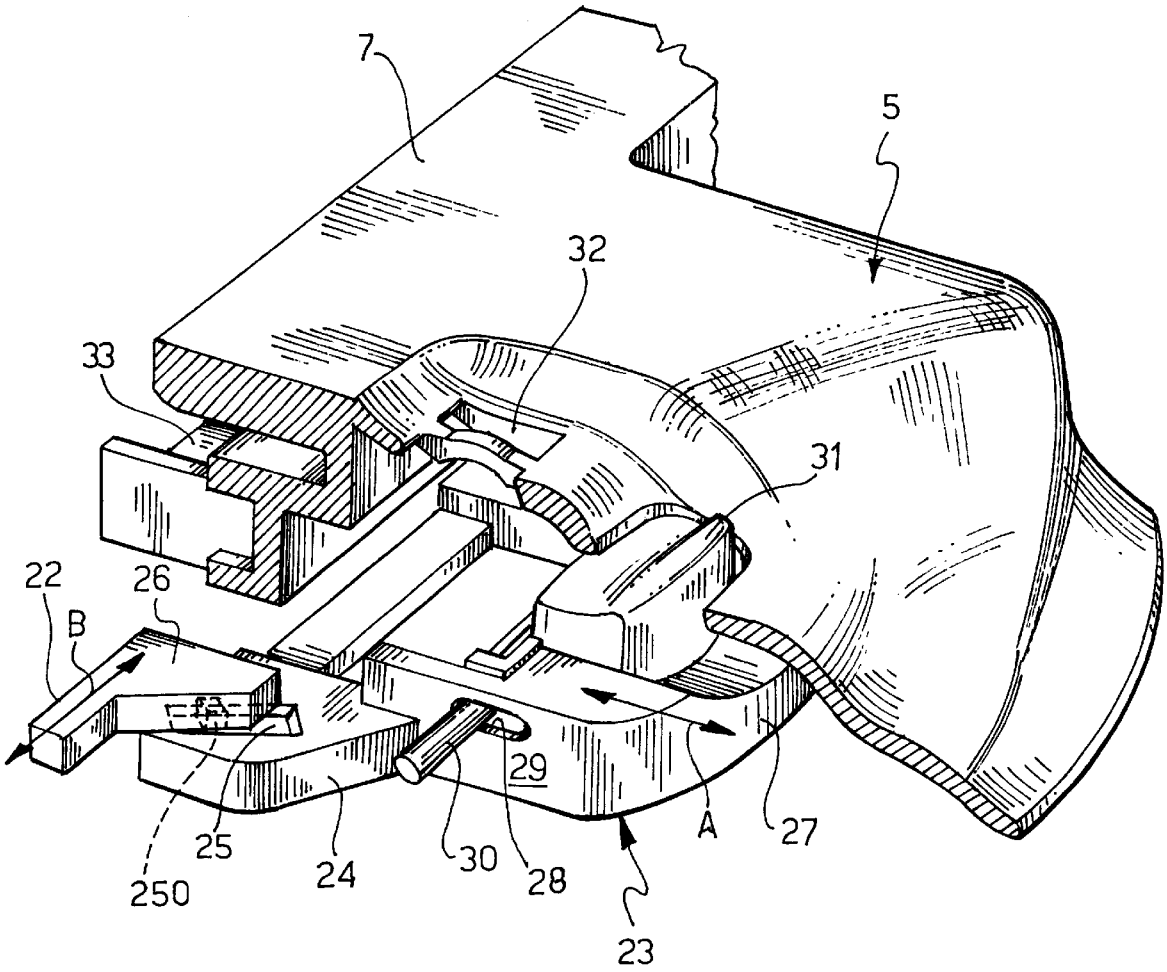
FIG. 5 shows, in an axonometric view and in partial section, a detail of the closing assembly.

The two arms 22 can be moved simultaneously by means of a single central control slider 23 housed in the central part 5 of the one-piece body and slidable transversely with respect to the arms 22, and consequently parallel to the direction of sliding of the locking sliders 20. With reference to FIG. 5, the central slider 23 comprises a central body 27, with a pair of slots 28 in the opposite side walls 29 of the central body, through which passes a guide pin 30 supported at both ends by the central part 5 of the one-piece body 1. The slider 23 is provided with two wings 24, each provided with a slot 25 which is oblique with respect to the direction of sliding of the slider 23. The oblique slot 25 slidably houses a projection 250 formed in an enlarged end 26 of the arms 22, in such a way that the movement of advance or withdrawal of the slider 23 in the direction of the arrow A in FIG. 5 is converted, by means of the sliding coupling formed by the slots 25 and the projections 250, into the movement of the arms 22 in the orthogonal direction indicated by the arrow B. The slider 23 can be operated manually by the user's action on a block 31 projecting from the upper surface of the central part 5 of the one-piece body 1 through an access aperture having suitable dimensions to allow the movement of the block 31.

A combination device 32, with a dial accessible externally to the user, is also preferably housed in the central part of the one-piece body 1. The combination device can be used to block the operation of the slider 23 by preventing its movement in the direction B, and consequently preventing the withdrawal of the arms 22 from the position shown in FIG. 6; in this way the locking sliders 20, being unable to slide when the release sliders 17 provided on the levers 14 are pressed, prevents the disengagement of the catches 18 of the levers from the corresponding counter-catches 19, and the disengagement of the sockets 41 from the corresponding projections 40.

Figure 8:
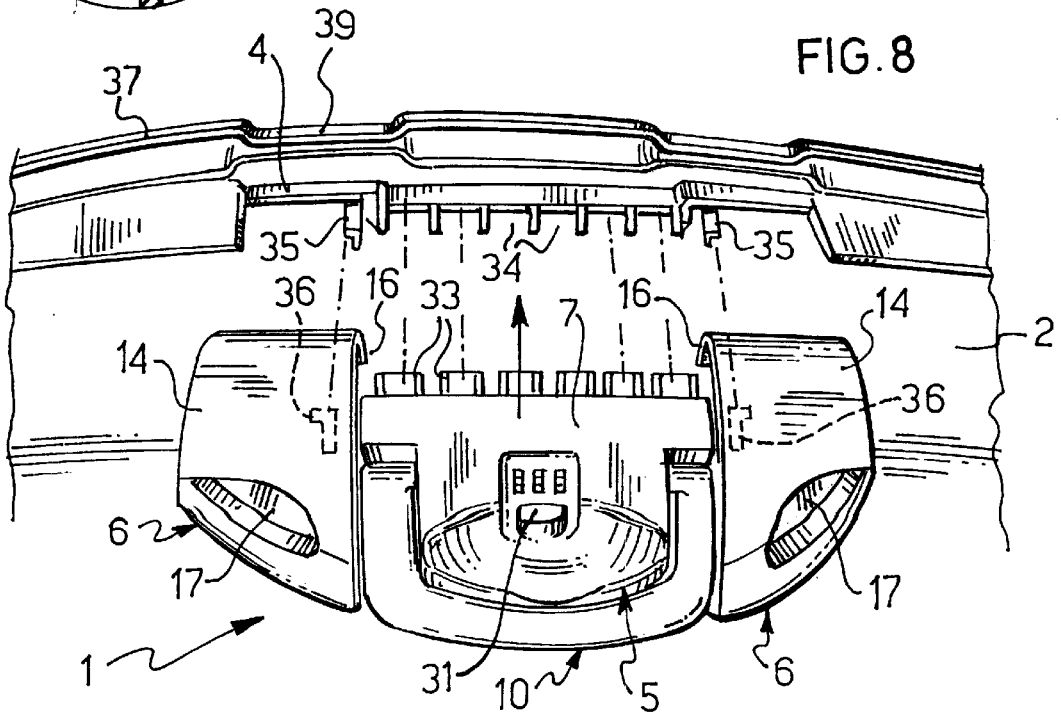
FIG. 8 shows in a perspective view the closing assembly, a suitcase designed to receive the closing assembly, and corresponding elements for joining the closing assembly to the suitcase.

FIGS. 2 and 8 show in detail the means for joining the closing assembly to the suitcase. A plurality of frontally projecting extensions 33, having a generally U-shaped cross section, is formed along the cross-piece of the one-piece body 1. These extensions 33 are designed to be inserted in corresponding sockets 34 of essentially rectangular section aligned along one edge 4 of the base half-shell 2 of a suitcase 3, for example a suitcase of the rigid type. The insertion of the extensions 33 into the corresponding sockets 34 is guided by a pair of guide elements 35 consisting essentially of undercuts insertable into two corresponding sockets 36 of matching shape formed frontally in the cross-piece 7, on the two sides of the plurality of extensions 33. This enables the closing assembly to be mounted on the suitcase in a fast and simple way, without the need to use additional fixing elements.

Figure 9:
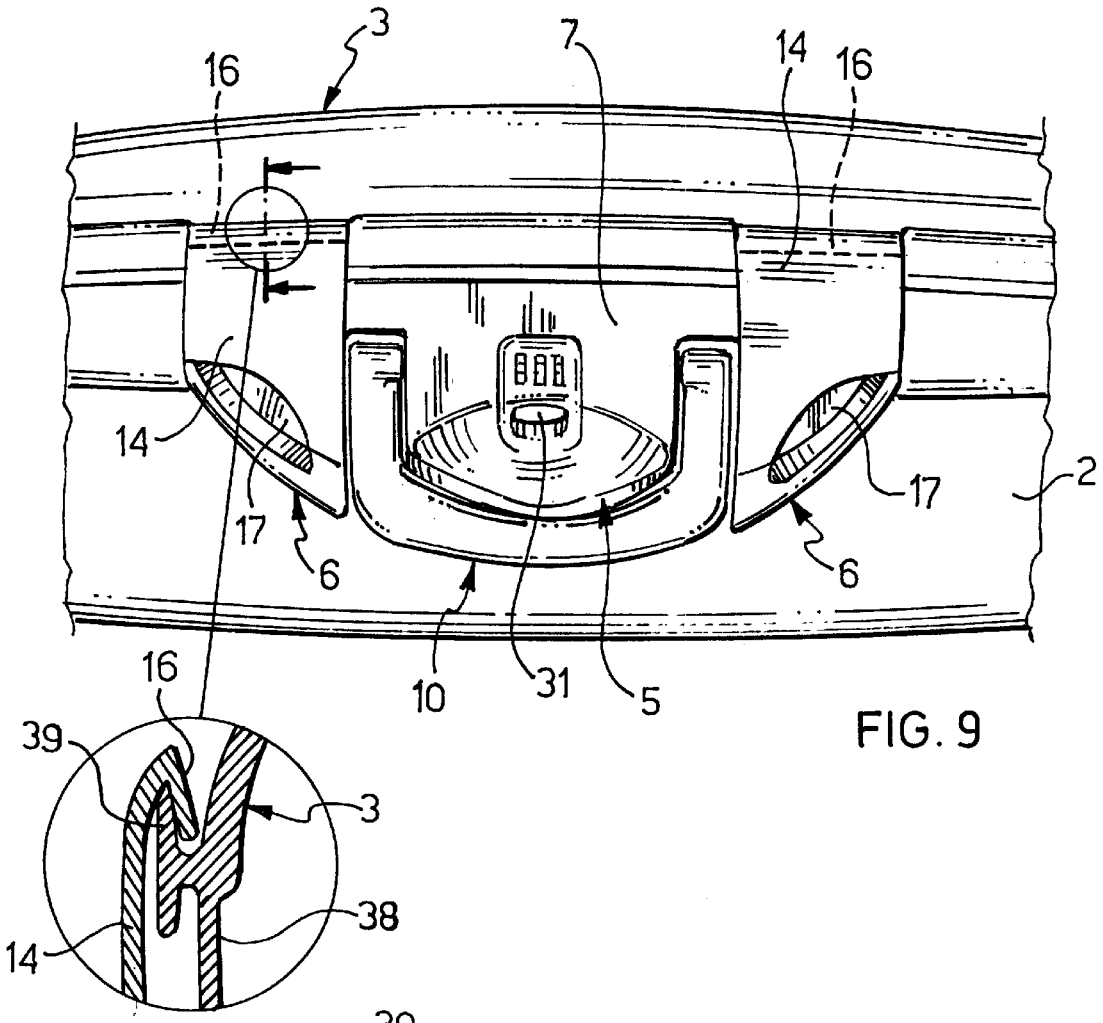
FIG. 9 shows in plan view from above the closing assembly applied to the suitcase, in an operating condition in which the suitcase is closed.

FIG. 9 shows the closing assembly according to the present invention attached to the suitcase 3, the latter being open. To close the suitcase, the half-shell 37 forming the lid of the suitcase 3 is initially positioned on the base 2 in such a way that the edges 4 of the base and 38 of the cover meet. By rotation of the levers 14 and the corresponding arms 12 about the pivots 13 and 11 respectively, the catches 16 at the ends of the levers 14 are brought into a position of engagement with corresponding counter-catches 39 formed in suitable positions in the edge 38 of the lid 37. Then, by means of pressure on the ends of the levers 14 opposite those at which the catches 16 are formed, the levers 14 and the corresponding arms 12 are rotated about the pivots 11, 13 respectively, while simultaneously exerting a tractive force on the lid 37. When the levers 14 are within the corresponding sockets 15 in the extensions 6, further pressure against the elastic pressure of the release sliders 17 causes the catches 18 to be snap-fitted into the corresponding counter-catches 19, and causes the projections 40 to be inserted into the corresponding sockets 41, thus locking the levers 14 in the closed position.

For opening, the release sliders 17 of the levers 14 are pressed to disengage the catches 18 from the corresponding counter-catches 19, and to disengage the sockets 41 from the corresponding projections 40, thus releasing the levers 14 which can then be raised.

However, if the block 31 is moved to cause the sliding of the slider 23 when the levers 14 are in the closed position, the arms 22 slide in the direction B shown in FIG. 5, thus blocking with their free ends the sliding channels of the locking sliders 20. In this way, even if the release sliders 17 are pressed, they cannot slide, since they are prevented from doing so by the locking sliders 20. Thus the catches 18 cannot be disengaged from the corresponding counter-catches 19, and the sockets 41 cannot be disengaged from the corresponding projections 40, and the levers 14 cannot be raised. Thus the opening of the suitcase is prevented.

For greater security, if the combination device 32 is operated after the block 31 has been moved to the locking position, the return of the block 31 to the release position is made impossible, thus making it impossible to open the suitcase until the correct combination is set by means of the dial of the locking device.

The closing assembly according to the present invention, comprising a pair of levers with catches capable of interacting with a corresponding pair of counter-catches, provides a good distribution of forces both during the operation of closing the suitcase and when the suitcase is closed. Moreover, since a one-piece body supporting the pair of levers with catches is provided, the assembly operations are fast and easy, it being unnecessary to mount the pair of levers individually. A further advantage due to the fact that the closing assembly is made in the form of a one-piece body which can be separated from the suitcase lies in the ease of replacement of the assembly in case of malfunction or breakage.

The provision of the single slider 23, which causes the locking and release of both levers 14 simultaneously, makes the use of the closing assembly easy and fast. Moreover, since the single slider 23 causes the locking and release of both levers 14, it is possible to provide a single security device, consisting of a combination device in the example described, for the secure locking of the closing assembly in the closed condition, thus resolving the problems encountered in the prior art.

Yet another advantage of the closing assembly according to the invention lies in the fact that it also acts as a support for the mounting of the handle. This makes it unnecessary to provide further hinge means of the handle on the suitcase.

The result is also particularly pleasing from the aesthetic point of view.

The closing assembly according to the invention can be used advantageously for the frontal closing of suitcases, particularly but not exclusively of the rigid type, bags, or similar, on its own or in combination with other closing elements, for example side closing elements.

Clearly, variations of and/or additions to the invention as described above and as illustrated may be made without departure from the scope of protection defined in the following claims.

In the first place, although reference was made in the preceding description to a pair of levers with ends in the form of catches and to a corresponding pair of counter-catches, it is clear that the closing assembly according to the invention may comprise a larger number of levers and counter-catches.

It is also clear that the levers with ends in the form of catches and the corresponding counter-catches may have configurations different from those described.

As an alternative to the combination device 32, it would also be possible to use a key-operated device, or more generally any security device operable only by the legitimate owners of the suitcase.

I claim:

1. A closing assembly for bags and suitcases comprising:

at least one pair of catch means associated with a first half-shell of a bag or suitcase, the catch means being capable of providing a releasable engagement with a corresponding pair of counter-catch means associated with a second half-shell of the bag or suitcase, said releasable engagement for closing the bag or suitcase; and jointly activatable inhibition means for inhibiting the opening of the bag or suitcase, operationally connected to the said at least one pair of catch means, wherein the inhibition means are jointly activatable to simultaneously inhibit the release of the releasable engagement with the said pair of counter-catch means, and wherein the said catch means are movable between an open and a closed position and each of the catch means is provided with corresponding releasable locking means for locking the catch means in the closed position, and with corresponding release means for releasing the said releasable locking means, and the said jointly activatable inhibition means act simultaneously on the release means of the at least one pair of catch means and can be activated for the simultaneous inhibition of the release of the locking means of the at least one pair of catch means by the said release means.

2. The closing assembly according to claim 1, wherein the said at least one pair of catch means comprises a pair of swinging levers each having one end in the form of a catch.

3. The closing assembly according to claim 2, wherein the closing assembly is made in the form of a one-piece body supporting the said catch means and the said jointly activatable inhibition means, the said one-piece body being capable of being associated with one side of the first half-shell of the bag or suitcase by means of a geometrical fastening.

4. The closing assembly according to claim 3, wherein the said geometrical fastening is formed by slot-in fastening means.

5. The closing assembly according to claim 4, wherein the said one-piece body is provided with fastening means for the rotatable fastening of a carrying handle of the bag or suitcase.

6. The closing assembly according to claim 3, wherein the said one-piece body comprises a central body and at least one pair of lateral extensions joined to the central body by a cross-piece, the said lateral extensions supporting with hinges the said swinging levers and being provided with sockets to house the said levers when the levers are in the closed position.

7. The closing assembly according to claim 6, wherein the said releasable locking means comprise at least one pair consisting of a catch and counter-catch formed respectively in a release slider slidably associated with the said lever and in the said socket of the corresponding lateral extension, the said release slider additionally forming the said release means.

8. The closing assembly according to claim 7, wherein the said jointly activatable inhibition means comprise, for each of the said at least one pair of engagement means first yielding opposing means opposing the corresponding release slider which are constantly biased to oppose in a yielding way the operation of the release slider;

second means movable from a first operating position in which they do not interfere with the yielding opposing means to a second operating position in which they interfere with the yielding opposing means, thus making the opposition of the locking slider non-yielding; and third operating means to cause the simultaneous movement of the said second means.

9. The closing assembly according to claim 8, wherein:

the said first yielding opposing means comprise an opposing slider housed slidably in a first direction in each of the said lateral extensions and elastically biased in a condition opposing the corresponding release slider;

each of the said second means comprises a blocking element housed slidably in a second direction essentially orthogonal to the first direction in the said cross-piece in such a way that in the said second operating position the blocking element partially blocks a sliding channel of the opposing slider; and the said third operating means comprise an operating slider housed slidably in the said first direction in the central body and accessible for manual operation, the operating slider being coupled to each blocking element by means of a sliding coupling.

10. The closing assembly according to claim 9, wherein the said jointly activatable inhibition means comprise a security device which can be operated to inhibit the operation of the said operating slider.

11. The closing assembly according to claim 10, wherein the said security device is a combination or key-operated device housed in the said central body.

12. A closing assembly for bags or suitcases comprising:

a one-piece body which can be associated with a first half-shell of a bag or suitcase;

at least one pair of catch means, supported by the one-piece body, capable of providing a releasable engagement with a corresponding pair of counter-catch means associated with a second half-shell of the bag or suitcase, said releasable engagement for closing it; and inhibition means for inhibiting the opening of the bag or suitcase, operationally connected to the said at least one pair of catch means and operable to block the release of the engagement with the said pair of counter-catch means;

wherein the said catch means are movable between an open and a closed position and each of the catch means is provided with corresponding releasable locking means for locking the catch means in the closed position, and with corresponding release means for releasing the said releasable locking means, and the said jointly activatable inhibition means act simultaneously on the release means of the at least one pair of catch means and can be activated for the simultaneous inhibition of the release of the locking means of the at least one pair of catch means by the said release means.

13. The closing assembly according to claim 12, wherein the said one-piece body can be removably associated with the one side of the first half-shell of the bag or suitcase by means of a geometrical fastening.

14. The closing assembly according to claim 13, wherein the said geometric fastening is formed by slot-in fastening means.

15. The closing assembly according to claim 13, wherein the said one-piece body is provided with fastening means for the rotatable fastening of a carrying handle for the bag or suitcase.

16. A bag or suitcase, comprising a first and a second half-shells, and a closing assembly according to claim 12.

17. A bag or suitcase, comprising a first and a second half-shells, and a closing assembly according to claim 1.

* * * * *